US011008808B1

(12) United States Patent
Constable et al.

(10) Patent No.: US 11,008,808 B1
(45) Date of Patent: May 18, 2021

(54) WHEELED GATE SUPPORT

(71) Applicants: Larry Dean Constable, Thornton, CO (US); Karen Ann Constable, Thornton, CO (US)

(72) Inventors: Larry Dean Constable, Thornton, CO (US); Karen Ann Constable, Thornton, CO (US)

( * ) Notice: Subject to any disclaimer, the term of this patent is extended or adjusted under 35 U.S.C. 154(b) by 0 days.

(21) Appl. No.: 16/996,451

(22) Filed: Aug. 18, 2020

(51) Int. Cl.
*E04H 17/16* (2006.01)
*E06B 11/04* (2006.01)
*E06B 11/02* (2006.01)

(52) U.S. Cl.
CPC ..... *E06B 11/04* (2013.01); *E06B 11/022* (2013.01)

(58) Field of Classification Search
CPC ..... E06B 11/04; E06B 11/022
USPC ..... 49/396; 256/73
See application file for complete search history.

(56) References Cited

U.S. PATENT DOCUMENTS 93,027 A * 7/1869 Wilde ..... E06B 11/04 49/396
335,028 A * 1/1886 Giles ..... E06B 11/04 49/396
498,124 A * 5/1893 Keith ..... E06B 11/04 49/396
572,228 A * 12/1896 Swink ..... B61D 19/009 49/156
603,212 A * 4/1898 Stevens ..... E05F 1/043 49/236
683,694 A * 10/1901 Livingstone ..... E06B 11/04 49/191
1,132,389 A * 3/1915 Ross ..... E06B 11/04 49/160
1,200,879 A * 10/1916 Harrison ..... E05D 7/04 16/235
1,409,468 A * 3/1922 Reading, Jr. ..... E06B 11/04 49/396
1,567,932 A * 12/1925 Eschenbacher ..... E06B 11/04 49/396
1,631,416 A * 6/1927 Howard ..... E05F 15/624 49/358
1,636,571 A * 7/1927 Liepold ..... E06B 11/04 49/396
2,066,448 A 1/1937 Bahr
2,426,380 A * 8/1947 Swanson ..... E06B 11/04 49/247
2,665,508 A * 1/1954 Swanson ..... E06B 11/04 49/147

(Continued)

FOREIGN PATENT DOCUMENTS

FR 3064021 A1 * 9/2018 ..... E05D 7/06
WO 99/61743 A1 12/1999

*Primary Examiner* — Jerry E Redman
(74) *Attorney, Agent, or Firm* — Timothy Snyder

(57) ABSTRACT

A wheeled gate support is described herein. The wheeled gate support includes a front wheel in-line with a rear wheel, one or more side frames, and a post. The one or more side frames assemble to opposing sides of the wheels. The post has a bottom portion and a top portion. The bottom portion assembles to the one or more side frames to form a pivot point and the top portion is configured to assemble to one or more gate rails of a gate. The wheels can therefore pivot about the pivot point while rolling along the ground to assist a user with opening and closing a gate along rough or bumpy terrain. A wheeled gate support kit is also provided.

20 Claims, 8 Drawing Sheets

(56) References Cited

U.S. PATENT DOCUMENTS

| | | | | | |
|---|---|---|---|---|---|
| 3,988,860 | A * | 11/1976 | Nevarez | E05F 15/627 | 49/396 |
| 4,073,093 | A * | 2/1978 | Ookawa | E06B 5/20 | 49/303 |
| 4,341,181 | A | 7/1982 | Fair | | |
| 4,520,592 | A * | 6/1985 | Holloway | E05F 15/624 | 49/25 |
| 6,477,984 | B1 * | 11/2002 | Kleinsasser | A01K 1/0029 | 119/510 |
| 7,930,801 | B2 * | 4/2011 | Hilger | E05F 7/06 | 16/32 |
| 9,226,476 | B2 | 1/2016 | Wilson | | |
| 2005/0150611 | A1 | 7/2005 | Cook | | |
| 2020/0040600 | A1 | 6/2020 | Mollhagen | | |

* cited by examiner

WHEELED GATE SUPPORT

TECHNICAL FIELD

The present invention generally relates to gates, and more particularly to a wheeled gate support to assist in opening and closing a gate along rough or bumpy terrain.

BACKGROUND

Gates are hinged barriers used for a variety of purposes. Gates can vary by size, construction materials, configuration, and operation. One particular type of gate is a swing gate, which is designed to swing open and close about a fixed post. These gates may have vertical or horizontals rails, poles, or slats, and at least one hinge mechanism to permit the gate to open and close. Swing gates are routinely used outdoors as entry barriers between plots of land and animal corrals on farms. In general, these swing gates are supported like a cantilever, with one end fixed to a post while the other end is free to rotate about the post. In some configurations, the free end of the swing gate may have a foot that rests against the ground to support the gate. In order to open or close the gate, a person needs to lift the foot off the ground and swing the gate open or closed. This can be quite cumbersome for long and/or heavy gates, and the foot may not always clear rough or bumpy terrain while opening or closing the gate throughout its range of motion. In other configurations, the free end may hover above the ground. However, gravity and other downward forces can cause the free end to lean towards the ground over time, eventually touching the ground surface or causing damage to the hinges.

Thus there exists a need in the art for a wheeled gate support to support the free end of a gate and assist in opening and closing a gate over rough or bumpy terrain.

SUMMARY

A wheeled gate support is described herein. The wheeled gate support includes a front wheel in-line with a rear wheel, a first side frame, and a post. The first side frame is assembled to a first side of the wheels. The post has a bottom portion and a top portion. The bottom portion is assembled to the first side frame thereby forming a pivot point, and the top portion is configured to assemble to one or more rails of a gate. The wheels may therefore pivot about the pivot point while rolling along the ground to assist a user in opening and closing a gate along rough or bumpy terrain. The wheeled gate support may further include a second side frame assembled to an opposing side of the wheels. The post may assemble between the side frames and between the front wheel and the rear wheel. The top portion of the post may further include one or more notches to receive at least a portion of a gate rail therein to assist in securing the wheel gate support to a gate.

A wheeled gate support kit is also provided. The wheeled gate support kit includes the components for the wheeled gate support in a disassembled state to be sold and shipped to an end-user for assembly. The wheeled gate support kit includes a front wheel and a rear wheel, a pair of side frames, a post, and fastening hardware. The pair of side frames are configured to assemble the front wheel in-line with the rear wheel. The post has a bottom portion and a top portion. The bottom portion is configured to assemble to the side frames between the front wheel and rear wheel to form a pivot point, and the top portion is configured to assemble to one or more rails of a gate. The top portion further includes one or more notches spaced along a length of the top portion to receive at least a portion of a gate rail therein. Various fastening hardware is provided to facilitate the assembly of the wheeled gate support, and to facilitate the assembly of the wheeled gate support to a gate.

BRIEF DESCRIPTION OF THE DRAWINGS

Examples illustrative of embodiments are described below with reference to figures attached hereto. In the figures, identical structures, elements or parts that appear in more than one figure are generally labeled with a same numeral in all the figures in which they appear. Dimensions of components and features shown in the figures are generally chosen for convenience and clarity of presentation and are not necessarily shown to scale. The figures are listed below.

FIG. 5A depicts the wheels in a first seesaw position, and FIG. 5B depicts the wheels in a second seesaw position.

DETAILED DESCRIPTION

Figure 1:
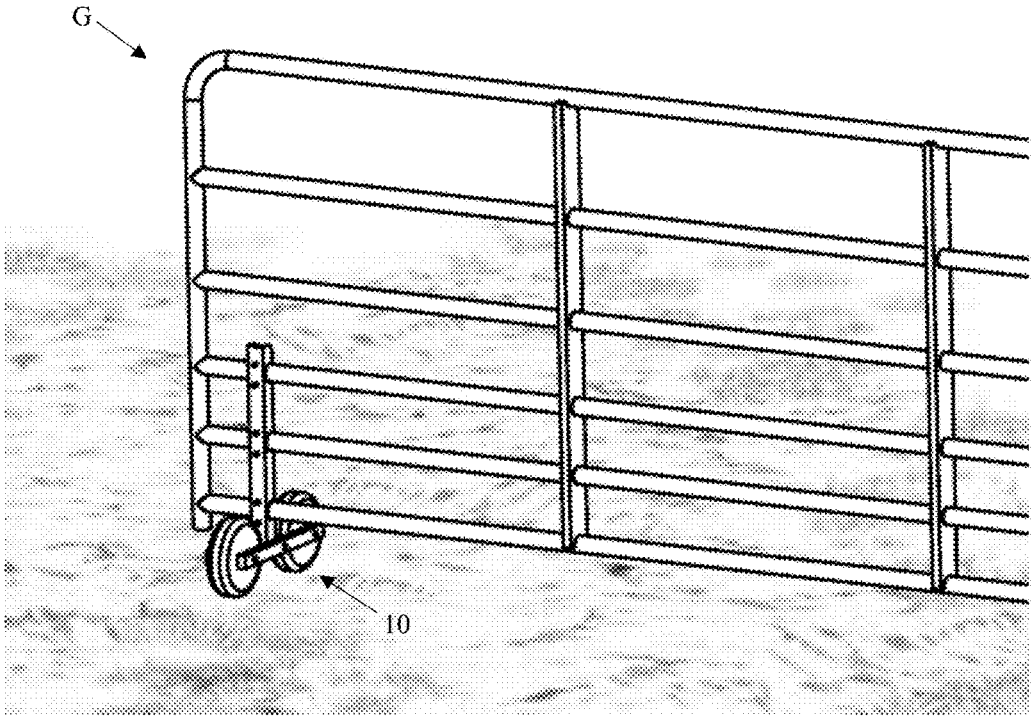
FIG. 1 depicts a wheeled gate support assembled to a gate in an outdoor setting.

The present invention has utility as wheeled gate support to support a free end of a gate and to assist with opening and closing a gate along rough or bumpy terrain. Embodiments of the present invention provide a wheeled gate support that is particularly useful for assembling to pipe gates and for assisting in opening and closing pipe gates that are 6 feet in horizontal length or longer. Further, the wheeled gate support includes two in-line wheels capable of seesawing about a pivot point that permits the wheels to easily traverse rough or bumpy terrain while opening or closing the gate.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention.

Unless indicated otherwise, explicitly or by context, the following terms are used herein as set forth below.

As used in the description of the invention and the appended claims, the singular forms "a," "an" and "the" are intended to include the plural forms as well, unless the context clearly indicates otherwise.

As used herein, "and/or" refers to and encompasses any and all possible combinations of one or more of the associated listed items, as well as the lack of combinations when interpreted in the alternative ("or").

As used herein, the term "gate rails", or "rails of a gate", refer to one or more rails, posts, slats, bars, or pipes that form a part of a gate. In particular embodiments, the gate described herein is a pipe gate where the "gate rails" are horizontal cylindrical pipes. However, it should be appreciated that embodiments of the invention can be adapted to accommodate other gates and gate rails (by shape, size, orientation, material, or otherwise), including those previously described.

Embodiments of the present invention describe a wheeled gate support having two or more in-line wheels capable of seesawing about a pivot point to assist with opening and closing a gate over rough or bumpy terrain. The wheeled gate support may be assembled to a previously installed gate, or integrated directly with a new gate and sold as a unit. A wheeled gate support kit is also described herein having the components required for an end user to assemble a wheeled gate support to a previously installed gate.

Figure 2:
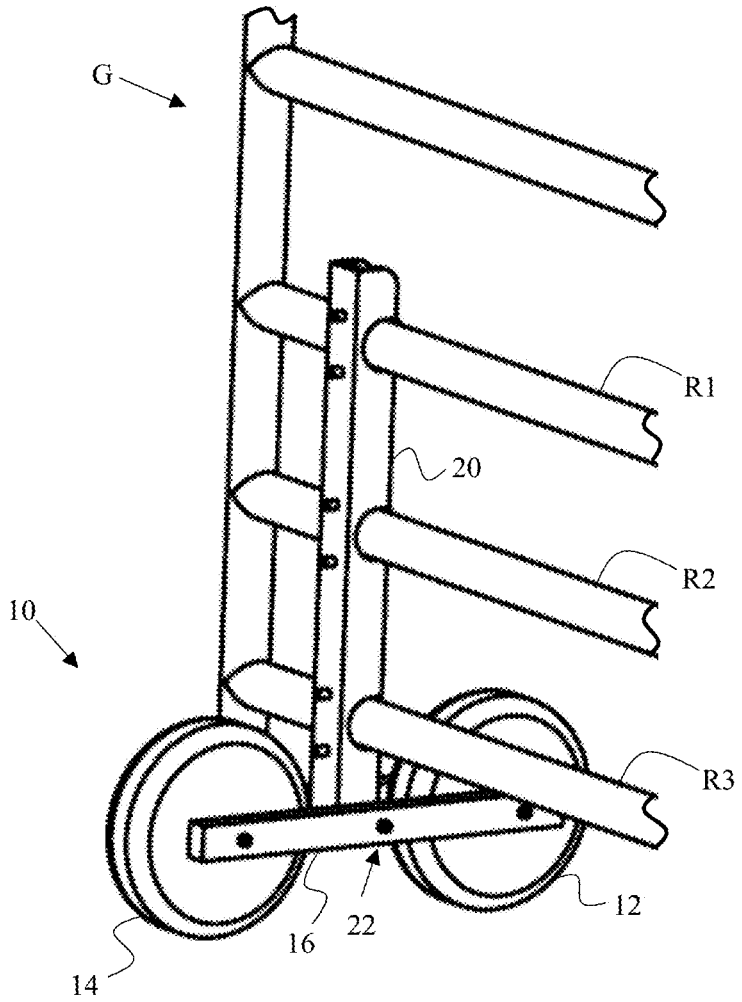
FIG. 2 depicts a perspective view of a wheeled gate support assembled to a gate.

Now with reference to the drawings, embodiments of a wheeled gate support 10 is shown throughout FIGS. 1 to 8. FIG. 1 depicts a wheeled gate support 10 assembled to a gate G in an outdoor setting, and FIG. 2 depicts a perspective view of a wheeled gate support 10 assembled to three gate rails (R1, R2, R3) of a gate G. The components of a wheeled gate support 10 is best seen in FIGS. 3 to 9. The wheeled gate support 10 generally includes a front wheel 12, a rear wheel 14, a first side frame 16, a second side frame 18, and a post 20. The front wheel 12 is in-line with the rear wheel 14, with the first side frame 16 assembled to a first side of the wheels (12, 14) and the second side frame 18 assembled to an opposing side of the wheels (12, 14). The post 20 includes a bottom portion and a top portion. The bottom portion of the post 20 assembles with the side frames (16, 18) thereby forming a pivot point 22, and the top portion of the post 20 is configured to assemble with one or more gate rails (e.g., R1, R2, and/or R3). The wheels (12, 14) may therefore seesaw about the pivot point 22 while rolling along the ground, where the seesaw action is best seen by comparing FIGS. 6A and 6B. Specific embodiments of the wheeled gate support 10 is further described below.

The front wheel 12 and rear wheel 14 may be any wheel conventional in the art. The wheels (12, 14) and/or its components may be made of metals, polymers, or a combination thereof. The wheels (12, 14) may additionally have inflatable tires to easily traverse over rough or bumpy terrain. The wheels (12, 14) may further include bearings and/or holes (36*a*, 36*b*) to receive a bolt, an axle, or a shaft to assemble the wheels (12, 14) to the side frames (16, 18) and to permit the wheels to freely rotate. The front wheel 12 and rear wheel 14 may be equal in size (e.g., the same diameter), or may differ depending on the application.

The first side frame 16 and second side frame 18 are configured to assemble the front wheel 12 in-line with the rear wheel 14, and assemble with the post 20. The frames (16, 18) may be constructed with metal or polymeric materials. The overall length of each frame (16, 18) may be equal to or greater than the diameter of a wheel (12 or 14) such that the frames (16, 18) can assemble the front wheel 12 in-line with the rear wheel 14. In particular embodiments, the side frames (16, 18) are elongated with a rectangular cross-section, and may be made of rectangular metal tubing. Each side frame (16, 18) may further include three holes (38*a-c*, and 39*a-c*) (as referenced in FIG. 9) to facilitate the assembly of the side frames (16, 18) with the wheels (12, 14) and to the bottom portion of the post 20.

Figure 5:
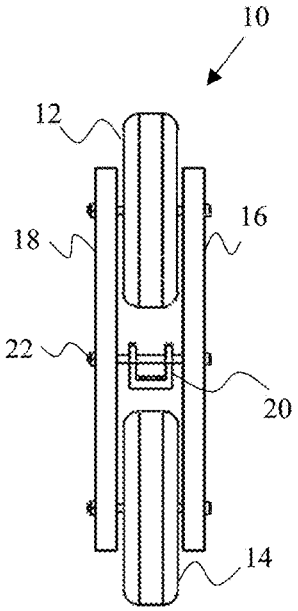
FIG. 5 depicts a top view of a wheeled gate support.

The post 20 has a bottom portion and top portion, where the bottom portion is configured to assemble with at least one side frame (16, 18) to form a pivot point, and the top portion is configured to assemble with one or more gate rails (R1, R2, R3) of a gate G. The top portion and bottom portion of the post 20 do not need to be of equal proportion. The post 20 may be constructed with metal or polymeric materials. In particular embodiments, the post 20 is elongated having a rectangular U-shaped cross-section as best seen in FIG. 5, with the open end facing towards the front wheel 12. However, it should be appreciated that the post 20 may have other cross-sectional shapes illustratively including circular, rectangular, triangular, U-shaped, or other symmetric or asymmetric shapes. A U-shaped cross-section (rectangular or otherwise) may be beneficial from a manufacturing and/or weight perspective as the post 20 is composed of less material compared to, for example, a circular or rectangular cross-section.

Figure 6A:
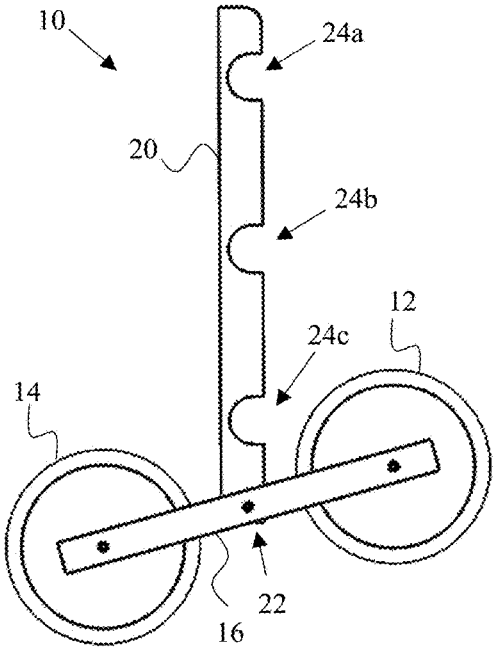
FIGS. 6A and 6B depict a side view of a wheeled gate support, where
Figure 6B:
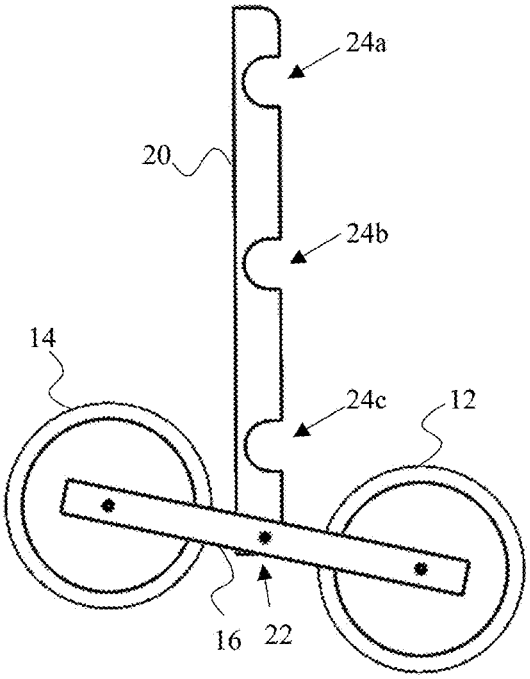

The post 20 may further include one or more notches (24*a*, 24*b*, 24*c*), where each notch is configured to receive at least a portion of a gate rail (R1, R2, R3) therein to facilitate the assembly of the wheeled gate support 10 to a gate G. The notches (24*a*, 24*b*, 24*c*) are spaced along the length of the post 20, where the spacing between notches (24*a*, 24*b*, 24*c*) may correspond with the spacing between two or more gate rails (R1, R2, R3). In a particular embodiment, the one or more notches (24*a*, 24*b*, 24*c*) are notched from the front face, front side, or front edge of the post 20 and extend towards a back side of the post 20. The lateral profile or shape of the notches (24*a*, 24*b*, 24*c*) may be semi-circular, U-shaped, V-shaped, or rectangular, although other shapes are possible. Notches (24*a*, 24*b*, 24*c*) with a U-shaped lateral profile are best seen in FIGS. 6A and 6B. In specific embodiments, at least a portion of the notches (24*a*, 24*b*, 24*c*) may have a lateral profile that matches at least a portion of the profile of a gate rail. For example, as shown in the figures, the back portion of the notches (24*a*, 24*b*, 24*c*) have a semi-circular profile to match the arced profile of a cylindrical pipe rail. The size of each notch (24*a*, 24*b*, 24*c*) may be 1% to 10% larger than a gate rail (R1, R2, R3) such that a portion of the gate rail can fit into each notch (24*a*, 24*b*, 24*c*). In particular embodiments, the post 20 includes three or more notches (24*a*, 24*b*, 24*c*) to assemble on three or more gate rails to form a particularly secure connection between the wheeled gate support 10 and the gate G.

Figure 3:
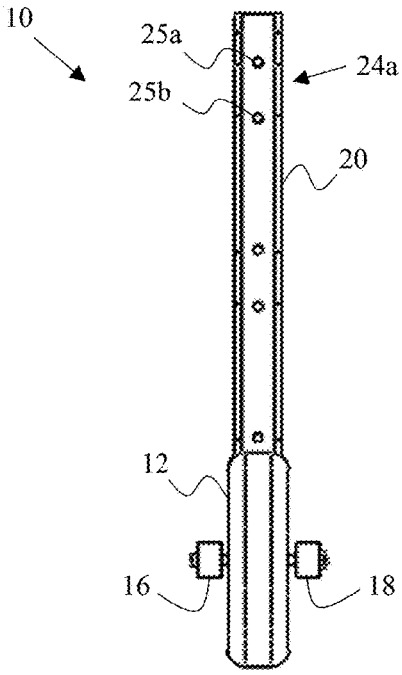
FIG. 3 depicts a front view of a wheeled gate support.
Figure 4:
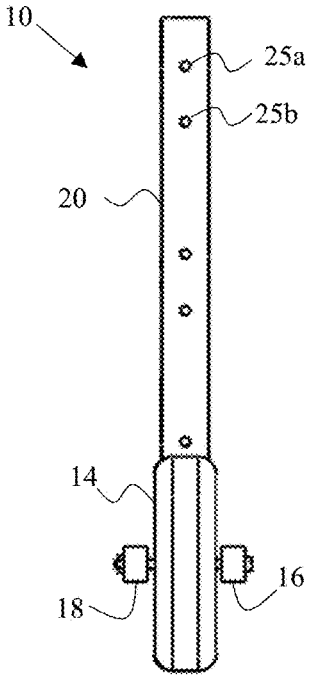
FIG. 4 depicts a rear view of a wheeled gate support.

The post 20 may further include an assembly hole 33 (as referenced in FIGS. 7 and 9), and one or more sets of two holes (25*a*, 25*b*) (as shown in FIGS. 3 and 4) associated with each notch (24*a*, 24*b*, 24*c*). The assembly hole 33 is situated at the bottom portion of the post 20 to facilitate the assembly of the side frames (16, 18) to the post 20 to form the pivot point 22. The assembly hole 33 may be bored through the lateral sides of the post 20, and may further include one or more bearings, spacers, or bushings. The one or more sets of two holes (25*a*, 25*b*) facilitate the assembly of the post 20 to one or more gate rails (R1, R2, R3). The one or more sets of two holes (25*a*, 25*b*) may be situated on a back side of the post 20 if the post 20 has a U-shaped cross-section. Alternatively, the one or more sets of two holes (25*a*, 25*b*) may be bored through the post, front-to-back, if the post 20 is solid or tubular (e.g., a post having a circular or rectangular cross-section). The two holes (25*a*, 25*b*) may be spaced apart by at least the height, width, or diameter of a gate rail (R1, R2, R3), with the two holes (25*a*, 25*b*) being positioned relative to opposing sides of their associated notch (24*a*, 24*b*, or 24*c*).

It should be appreciated, that the wheels (12, 14), side frames (16, 18), and post 20 described herein may be formed, created, or manufactured using techniques known in the art.

Figure 7:
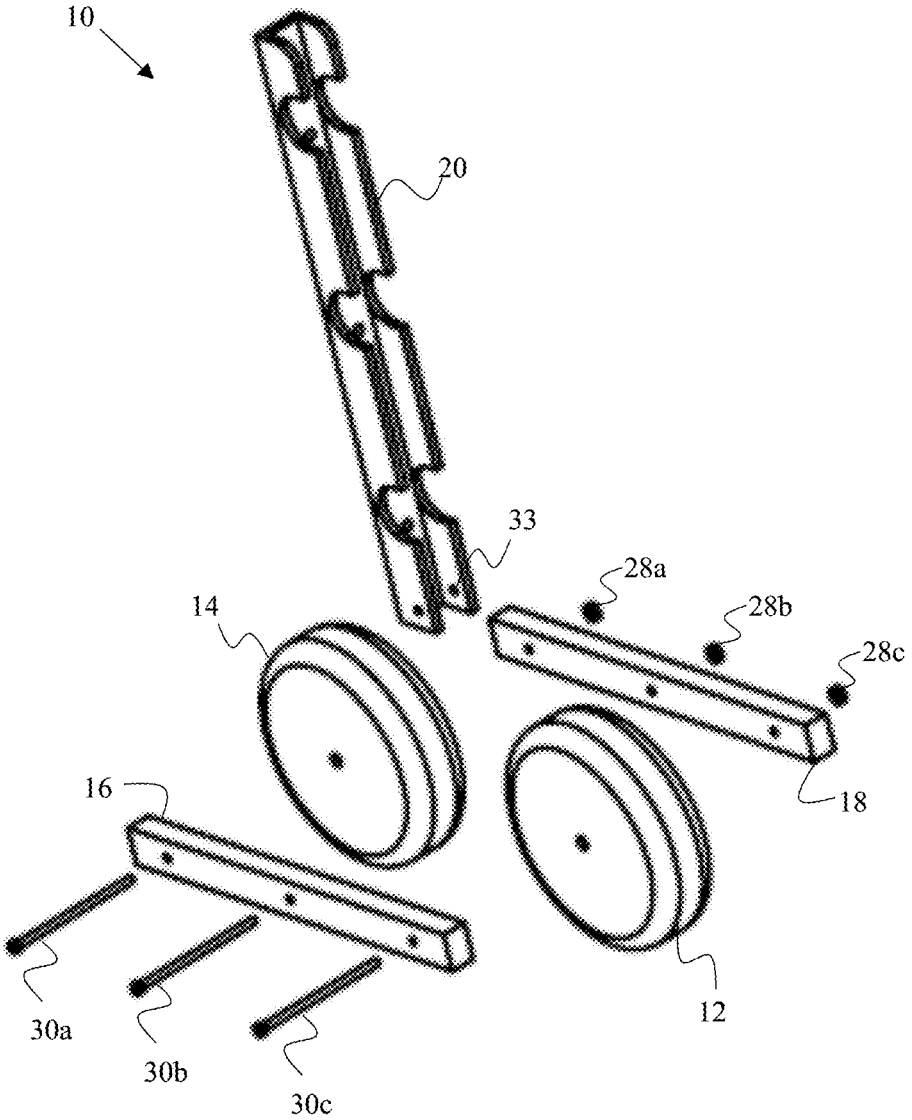
FIG. 7 depicts an exploded perspective view a wheeled gate support.
Figure 9:
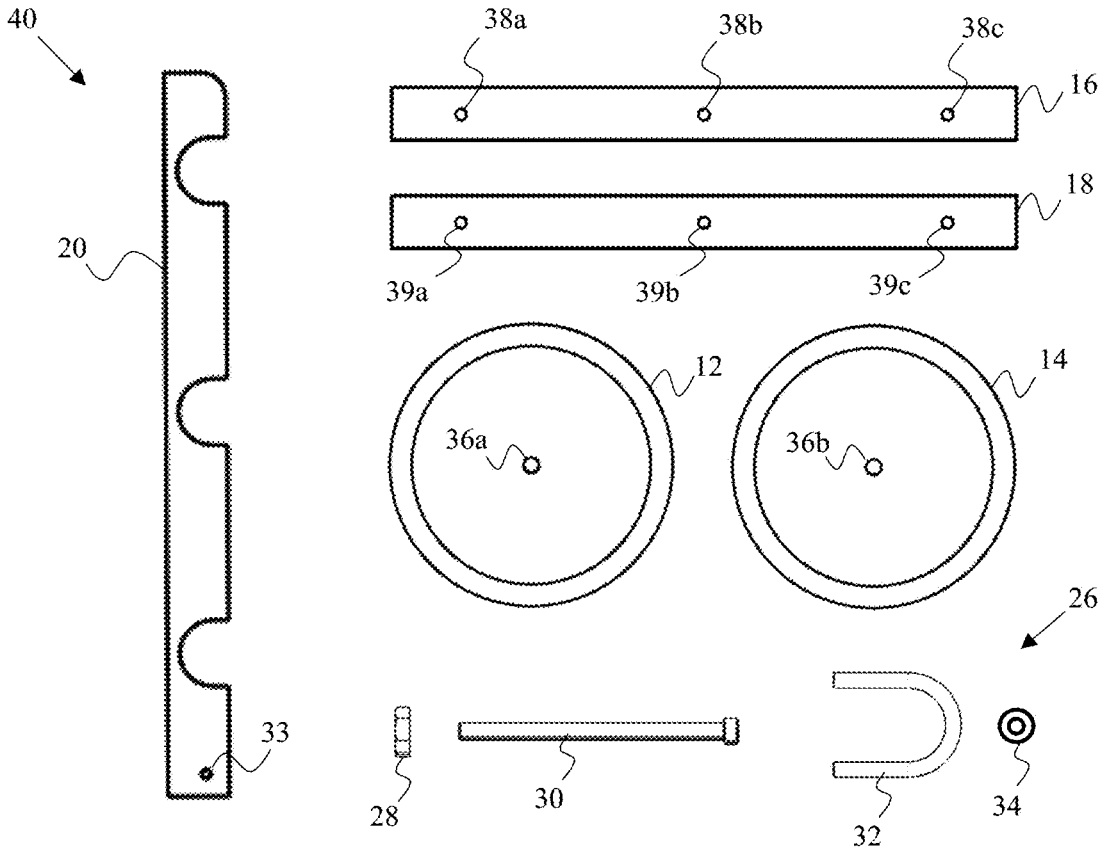
FIG. 9 depicts a wheeled gate support kit.

With reference now to FIG. 7, an exploded perspective view of a wheeled gate support 10 is shown. The wheeled gate support 10 includes fastening hardware to assemble the wheeled gate support 10 together. The fasting hardware may include, but not limited to, nuts, bolts, pivot pins, axles, spacers, bearings, bushings, clips, clamps, or other fastening elements. In particular embodiments, the fastening hardware includes at least three bolts (30*a*, 30*b*, 30*c*), three nuts (28*a*, 28*b*, 28*c*), and a plurality of spacers 34 (as shown in FIG. 9). The assembly of the wheeled gate support 10 may include the following. Bolt 30*a* is inserted through hole 38*a* in the first side frame 16, hole 36*b* in the rear wheel 14, hole 39*a* in the second side frame 18, and secured together by nut 28*a*. Various spacers, washers, or bearings may be placed along the length of bolt 30*a* including between the side frames (16,18) and the rear wheel 14. Bolt 30*b* is inserted through hole 38*b* in the first side frame, hole/s 33 in the bottom portion of the post 20, hole 39*b* in the second side frame 18, and secured with nut 28*b*. Bolt 30*b* may therefore be considered a pivot pin that allows the post 20 to rotate relative to the side frame (16, 18) thereby forming the pivot point 22. Likewise, various spacers, washers, or bearings may be placed along the length of bolt 30*b* including between the side frames (16, 18) and the post 20. Bolt 30*c* is inserted through hole 38*c* in the first side frame 16, hole 36*a* in the front wheel 12, hole 39*c* of the second side frame 18, and secured by nut 28*c*. Again, various spacers, washer, or bearing may be placed along the length of bolt 30*c* including between the side frames (16, 18) and the front wheel 12. In this assembled configuration, the post 20 is situated in a generally upright position relative to the side frames (16, 18), and is perpendicular to the side frames (16, 18) when the wheels (12, 14) are resting on a level surface. Furthermore, in this configuration, the post 20 situated between the front wheel 12 and the rear wheel 14, as well as between the first side frame 16 and second side frame 18, which allows the wheels (12, 14) to seesaw about the pivot point 22 as shown in FIGS. 6A and 6B. It should be appreciated that in certain embodiments, the bottom portion of the post 20 may be assembled to a single side frame, either on an inner or outer surface thereof, and still form a pivot point 22 that allows the wheels to seesaw.

Figure 8:
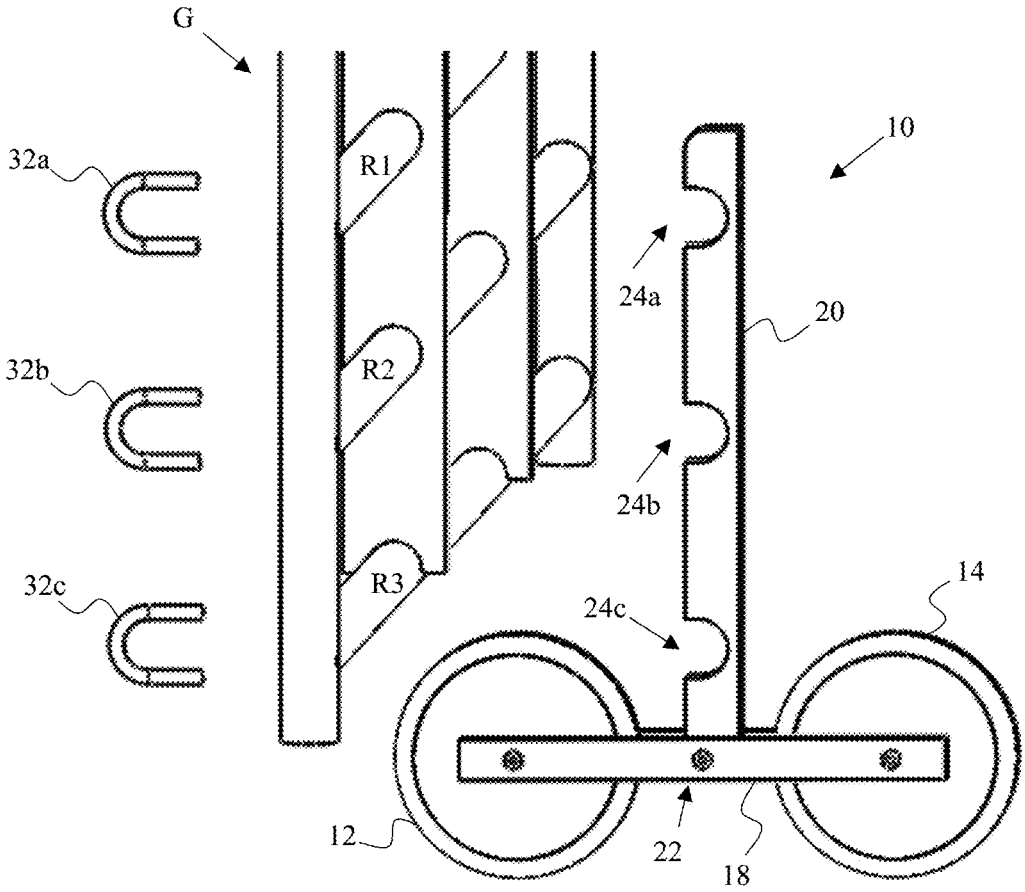
FIG. 8 depicts an exploded perspective view of a wheeled gate support being assembled to a gate.

Referring now to FIG. 8, an exploded perspective view of a wheeled gate support 10 being assembled to a gate G is shown. The fastening hardware may further include a plurality of U-bolts (32*a*, 32*b*, 32*c*) to assemble the wheeled gate support 10 to one or more gate rails (R1, R2, R3) of a gate G. The assembly of the wheeled gate support 10 to three gate rails (R1, R2, R3) may include the following. The wheeled gate support 10 is positioned on one side of the gate G. Each gate rail (R1, R2, R3) is then positioned into each notch (24*a*, 24*b*, 24*c*) (i.e., gate rail R1 fits into notch 24*a*, gate rail R2 fits into notch 24*b*, gate rail R3 fits into notch 24*c*). Each U-bolt (34*a*, 24*b*, 24*c*) then captures, or is placed around, their corresponding gate rail (R1, R2, R3) from the opposing side of the gate G, with the ends of each U-bolt fitting through each set of two holes (e.g., 25*a*, 25*b*) in the top portion of the post 20. The ends of each U-bolt are then secured with nuts to firmly secure the gate rails (R1, R2, R3) to the post 20. It should be appreciated that other securing mechanisms may be used to secure the gate G to the wheeled gate support 10 illustratively including, straight nuts and bolts, clips, clamps, clasp, welds, and straps. In specific embodiments, the top portion of the post is integrated directly with the gate G and/or one or more gate rails (R1, R2, R3) using manufacturing techniques known in the art. For example, the top portion of the post 20 may be welded to the gate rails (R1, R2, R3), where the gate G with the wheeled gate support 10 is sold as a single unit.

With reference now to FIG. 9, a wheeled gate support kit 40 is shown. The wheeled gate support kit 40 may include all the components of a wheeled gate support 10 in a disassembled state that may be sold and shipped to individual end-users for assembly. The wheeled gate support kit 40 may include a front wheel 12, a rear wheel 14, a pair of side frames (16, 18), a post 20, and fastening hardware 26. The pair of side frames (16, 18) are configured to assemble the front wheel 12 in-line with a rear wheel 14. The post 20 has a bottom portion and a top portion, where the bottom portion is configured to assemble to the side frames (16, 18) to form a pivot point, and the top portion is configured to assemble to one or more gate rails (R1, R2, R3). The top portion further includes one or more notches spaced along the length of the top portion to receive at least a portion a gate rail therein. The fastening hardware facilitates the assembly of a wheeled gate support 10 and may include a plurality of bolts 30, a plurality of nuts 28, a plurality of spacers 34, and a plurality of U-bolts 32. The plurality of spacers 34 may further refer to other "spacer" like hardware including washers, bearings, bushings, bumpers, nuts, etc.

Figure 10:
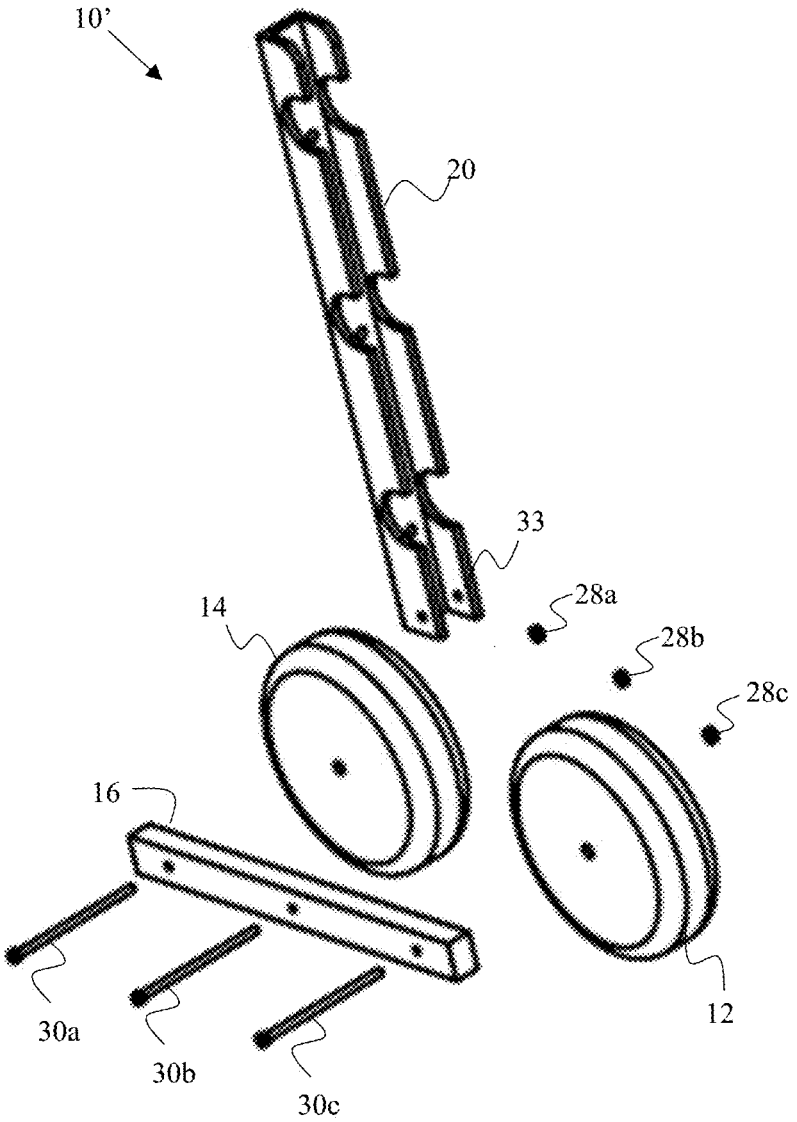
FIG. 10 depicts an exploded perspective view of a wheeled gate support with a single side frame.

With reference now to FIG. 10, a particular embodiment of a wheeled gate support 10' is shown in an exploded perspective view. The wheeled gate support 10' includes all the components of the previously described wheeled gate support 10 but without the second side frame 18. It is contemplated that the second side frame 18 may not be needed for the wheeled gate support 10' to operate in a similar fashion with the same advantages as the previously described wheeled gate support 10. However, a wheeled gate support 10 having a pair of support frames (16, 18) as shown in FIGS. 1 to 8 is more sturdy and resistant to wear when compared to the wheeled gate support 10' having only a single side frame 16 as shown in FIG. 10.

Figure 11:
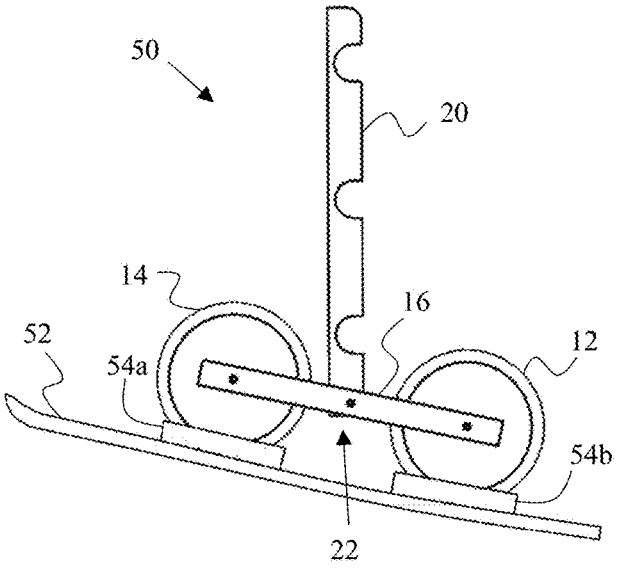
FIG. 11 depicts a side view of a ski gate support with a ski assembled to a front wheel and a rear wheel of a wheeled gate support.
Figure 12:
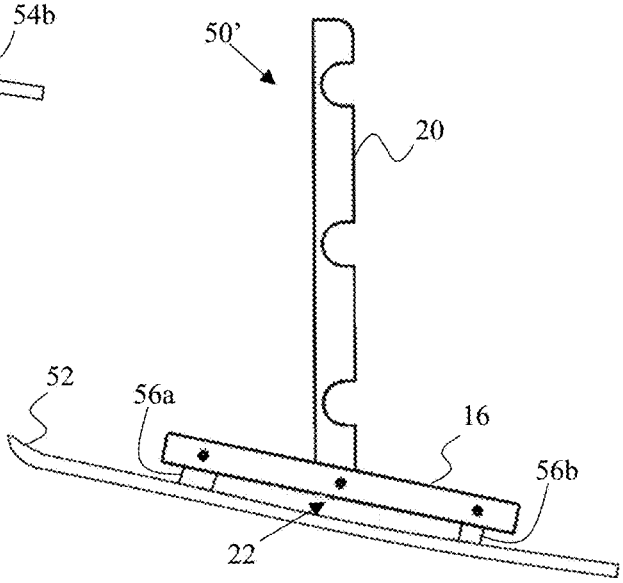
FIG. 12 depicts a side view of a ski gate support having a ski assembled to one or more side frames.
Figure 13:
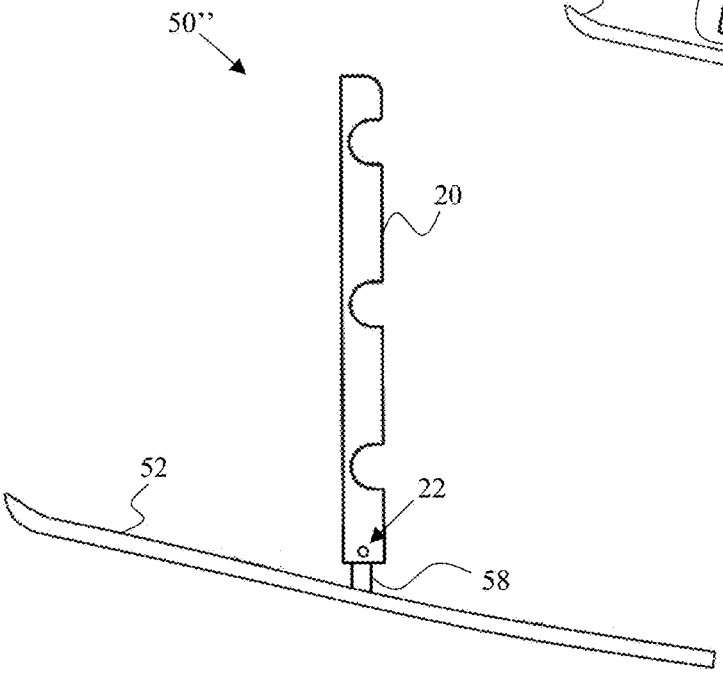
FIG. 13 depicts a side view of a ski gate support having a ski assembled to a post.

With reference now to FIGS. 11 to 13, various embodiments of a ski gate support (50, 50', 50") are shown to assist a user with opening and closing a gate along snow covered terrain. FIG. 11 depicts a ski gate support 50 having a front wheel 12 in-line with a rear wheel 14, one or more side frames (16 and/or 18), a post 20, a ski 52, and two ski attachment members (54*a*, 54*b*). The ski gate support 50 may be assembled in the same manner as the previously described wheeled gate supports (10, 10'), but now includes a ski 52 assembled to the front wheel 12 and rear wheel 14. The ski attachment members (54*a*, 54*b*) are configured to facilitate the assembly of the ski 52 to the front wheel 12 and rear wheel 14. The ski attachment members (54*a*, 54*b*) may illustratively include at least one of a boot, container, vessel, basket, frame, or fasting hardware designed to fasten, catch, or hold the ski 52 to the wheels (12, 14). The ski attachment members (54*a*, 54*b*) may include a gripping material (e.g., rubber) to form an interaction fit with the wheels (12, 14). In this configuration, the ski 52 is able to seesaw about the pivot point 22 while the ski is pushed along snow covered terrain.

FIG. 12 depicts a specific embodiment of a ski gate support 50' lacking a front wheel 12 and rear wheel 14. The ski gate support 50' may include one or more side frames (16 and/or 18), a post 20, a ski 52, and one or ski attachment members (56*a*, 56*b*). The post 20 and one or more frames (16 and/or 18) of the ski gate support 50' may be assembled in the same manner as the previously described wheeled gate supports (10, 10'). The ski attachment members (56*a*, 56*b*) are configured to attach the ski 52 directly to the one or more side frames (16 and/or 18). The attachment members (56*a*, 56*b*) may illustratively include a bar, rod, rail, post, tube, and/or fastening hardware to facilitate the assembly of the ski 52 to the one or more side frames (16 and/or 18). Likewise, on this configuration, the ski 52 is able to seesaw about the pivot point 22 while the ski is pushed along snow covered terrain.

FIG. 13 depicts a particular embodiment of a ski gate support 50" lacking a front wheel 12, a rear wheel 14, and the one or more side frames (16 and/or 18). The ski gate support 50" may include a post, a ski 52, and a ski attachment member 58. The ski attachment member 58 is configured to directly attach to the bottom portion of the post 20. The ski attachment member 58 may illustratively include a bar, rod, rail, post, tube, and/or fastening hardware to facilitate the assembly of the ski 52 to the bottom portion of the post 20 to form a pivot point 22. Therefore, the ski 52 is able to seesaw about the pivot point 22 while the ski is pushed snow covered terrain.

OTHER EMBODIMENTS

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient roadmap for implementing the exemplary embodiment or exemplary embodiments. It should be understood that various changes may be made in the function and arrangement of elements without departing from the scope as set forth in the appended claims and the legal equivalents thereof.

The invention claimed is:

1. A wheeled gate support, comprising:

a front wheel in-line with a rear wheel;

a first side frame assembled to a first side of the wheels;

a post having a bottom portion and a top portion, wherein the bottom portion is assembled to the first side frame between the front wheel and the rear wheel thereby forming a pivot point, and the top portion is configured to assemble to one or more gate rails;

fastening hardware assembling the bottom portion of the post with the first side frame, wherein the first side frame and the bottom portion of the post each comprise a hole in which the fastening hardware is inserted through to assemble the post to the first side frame without constraining rotation to form the pivot point;

a second side frame assembled to an opposing side of the wheels, wherein the bottom portion of the post is assembled to the second side frame via the fastening hardware inserted through a hole in the second side frame; and wherein the wheels seesaw about the pivot point while rolling along a ground surface to assist a user in opening and closing a gate along rough or bumpy terrain.

2. The wheeled gate support of claim 1 wherein at least one of the fastening hardware is selected from the group consisting of a bolt, a pivot pin, an axle, a shaft, and a bearing.

3. The wheeled gate support of claim 1 wherein the top portion of the post is integrated with the one or more gate rails.

4. A wheeled gate support, comprising:

a front wheel in-line with a rear wheel;

a first side frame assembled to a first side of the wheels;

a post having a bottom portion and a top portion, wherein the bottom portion is assembled to the first side frame thereby forming a pivot point, and the top portion is configured to assemble to one or more gate rails;

wherein the wheels seesaw about the pivot point while rolling along a ground surface to assist a user in opening and closing a gate along rough or bumpy terrain; and wherein the top portion of the post comprises one or more notches spaced along a length of the top portion, wherein the one or more notches are configured to receive the one or more gate rails respectively therein.

5. The wheeled gate support of claim 4 wherein the bottom portion of the post is assembled to the first side frame between the front wheel and the rear wheel.

6. The wheeled gate support of claim 5 wherein the bottom portion of the post is assembled to the first side frame with fastening hardware, wherein at least one of the fastening hardware is selected from the group consisting of a bolt, a pivot pin, an axle, a shaft, and a bearing.

7. The wheeled gate support of claim 6 wherein the first side frame and bottom portion of the post each comprise a hole, wherein the fastening hardware is inserted through each of the holes to assemble the post to the first side frame without constraining rotation therebetween to form the pivot point.

8. The wheeled gate support of claim 4 further comprising a second side frame assembled to an opposing side of the wheels, wherein the bottom portion of the post is assembled to the second side frame via the fastening hardware inserted through a hole in the second side frame.

9. The wheeled gate support of claim 4 wherein the profile of each notch is a semi-circle or a U-shape.

10. The wheeled gate support of claim 4 wherein the top portion comprises three notches.

11. The wheeled gate support of claim 4 wherein the post has a U-shaped cross-section or a rectangular U-shaped cross-section.

12. The wheeled gate support of claim 4 wherein the top portion comprises two or more notches configured to assemble with two or more gate rails respectively and the spacing between the two or more notches corresponds to the spacing between the two or more gate rails.

13. The wheeled gate support of claim 4 further comprising one or more U-bolts to assemble to the top portion of the post with the one or more gate rails, wherein the top portion of the post comprises one or more sets of two holes situated on a back side of the post, wherein each set of two holes is associated with each notch, and wherein each U-bolt is configured to capture the one or more gate rails in each notch respectively and fit through the two holes to secure the one or more gate rails to the post.

14. A wheeled gate support for a gate, comprising:

a front wheel in-line with a rear wheel;

a pair of side frames assembled to opposing sides of the wheels;

a post having a bottom portion and a top portion, wherein the bottom portion is assembled to the side frames between the front wheel and the rear wheel thereby forming a pivot point, and the top portion is configured to assemble to one or more gate rails;

wherein the top portion comprises one or more notches spaced along a length of the top portion, wherein the one or more notches are configured to receive the one or more gate rails respectively therein; and wherein the wheels seesaw about the pivot point while rolling along a ground surface to assist a user in opening and closing a gate along rough or bumpy terrain.

15. The wheeled gate support of claim 14 wherein the side frames and bottom portion of the post each comprise a hole, wherein fastening hardware is inserted through each of the holes to assemble the post to the side frames without constraining rotation therebetween to form the pivot point, and wherein at least one of the fastening hardware is selected from the group consisting of a bolt, an axle, a shaft, a pivot pin, and a bearing.

16. The wheeled gate support of claim 14 wherein the top portion comprises three notches configured to assemble with three gait rails respectively, wherein the spacing between the three notches correspond to the spacing between the three gate rails, and wherein a profile of each notch is a semi-circle or a U-shape.

17. The wheeled gate support of claim 14 further comprising one or more U-bolts to assemble the top portion of the post with the one or more gate rails, wherein the top portion of the post comprises one or more sets of two holes situated on a back side of the post, wherein each set of two holes is associated with each notch, and wherein each U-bolt is configured to capture the one or more gate rails in each notch respectively and fit through the two holes to secure the one or more gate rails to the post.

18. The wheeled gate support of claim 14 wherein the top portion of the post is integrated with the one or more gate rails.

19. A wheeled gate support kit for a gate, comprising:

a front wheel and a rear wheel;

a pair of side frames to assemble the front wheel in-line with a rear wheel;

a post having a bottom portion and a top portion, wherein the bottom portion is configured to assemble to the side frames between the front wheel and the rear wheel to form a pivot point, and wherein the top portion is configured to assemble to the one or more gate rails, wherein the top portion comprises one or more notches spaced along a length of the top portion to receive the one or more gate respectively therein; and fastening hardware to facilitate assembly of the front wheel, the rear wheel, the pair of side frames, and the post.

20. The wheeled gate support kit of claim 19 wherein the top portion comprises two or more notches and the fastening hardware comprises a plurality of bolts, a plurality of nuts, a plurality of spacers, and a plurality of U-bolts.

* * * * *